US007540778B2

(12) United States Patent
Cheng

(10) Patent No.: US 7,540,778 B2
(45) Date of Patent: Jun. 2, 2009

(54) STACKED ELECTRICAL CARD CONNECTOR WITH GROUNDING SPACE

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/823,353

(22) Filed: Jun. 27, 2007

(65) Prior Publication Data

US 2007/0298660 A1 Dec. 27, 2007

(30) Foreign Application Priority Data

Jun. 27, 2006 (CN) ..... 2006 2 0074538 U

(51) Int. Cl.
*H01R 13/648* (2006.01)

(52) U.S. Cl. ..... 439/607; 439/181; 439/95

(58) Field of Classification Search ..... 439/607, 439/541.5, 181, 92, 95
See application file for complete search history.

(56) References Cited

U.S. PATENT DOCUMENTS 6,183,273 B1 * 2/2001 Yu et al. ..... 439/92
6,482,030 B1 * 11/2002 Kuo ..... 439/541.5
6,558,192 B1 * 5/2003 Kuo ..... 439/541.5
7,108,545 B2 * 9/2006 Ting ..... 439/541.5
7,377,815 B2 * 5/2008 Takao ..... 439/630

FOREIGN PATENT DOCUMENTS

CN 2770143 4/2006

* cited by examiner

*Primary Examiner*—Tho D Ta
*Assistant Examiner*—Travis Chambers
(74) *Attorney, Agent, or Firm*—Wei Te Chung

(57) ABSTRACT

A stacked electrical card connector (100) has a first insulating housing (1) including a base receiving a plurality of first terminals (3), a second insulating housing (2) having a plurality of second terminals (4), a first shielding shell (6) having a pair of elastic arms (63) extending forwardly from a front-end thereof, a second shielding shell (7) mounted on the second insulating housing, a grounding plate (8) engaging with the elastic arms of the first shielding shell for eliminating the static electricity when the card inserted into the first insulating housing. Said first insulating housing is located on the second insulating housing, and the first shielding shell, the second shielding shell are correspondingly mounted on the first insulating housing and the second insulating housing.

17 Claims, 6 Drawing Sheets

STACKED ELECTRICAL CARD CONNECTOR WITH GROUNDING SPACE

BACKGROUND OF THE INVENTION

1. Field of the Invention

The present invention relates to an electrical card connector for accessing electrical cards, such as memory cards, and more particularly to a stacked electrical card connector for receiving different kinds of cards, such as Smart Card and Card Bus.

2. Description of Prior Arts

An electrical card connector is used for receiving electrical cards, and can be mounted on an electrical product so as to allow electrical cards connected with electrical product. The electrical card connector generally has a receiving room, an insulating housing receiving a plurality of terminals and a shielding shell mounted on the insulating housing. Each terminal contacts with corresponding terminals arranged on the card.

To transmitting signal more efficiently, many of the electrical card connectors always have a grounding plate mounted on the insulating housing adjacent the terminals so as to eliminate the static electricity caused of the card inserted. The former type of the grounding plate is useful to a conventional electrical connector, and the static electricity can be eliminated by the shielding shell when the card is inserted into the insulating housing. However, a normal stacked electrical connector including an upper connector and a lower connector, the lower connector can eliminate the static electricity by the grounding plate, but the upper connector is mounted on the lower connector, and there is not a grounding plate fitted to the upper cover. Accordingly, it may be difficult to prevent the upper connector from being influenced by the static electricity when the card is inserted. Furthermore, it may influence the signal transmission.

It is an object of the present invention to solve the above described problems. The present invention provides a stacked electrical card connector which can reliably eliminate the static electricity.

SUMMARY OF THE INVENTION

An object, therefore, of the invention is to provide a stacked electrical connector, which can reliably eliminate the static electricity.

To achieve the above object, a stacked electrical card connector has a first insulating housing receiving a plurality of first terminals, a second insulating housing having a plurality of second terminals, a first shielding shell having a body portion and a plurality of lateral walls extending forwardly forming a pair of elastic arms, a second shielding shell including an upper portion and a pair of lateral walls, a grounding plate including a body portion and a pair of limbs. Said first insulating housing is located on the second insulating housing, and the first shielding shell, the second shielding shell are correspondingly mounted on the first insulating housing and the second insulating housing. The elastic arms of the first shielding shell lean against the limbs of the grounding plate for eliminating the noise for the card inserted into the first insulating housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
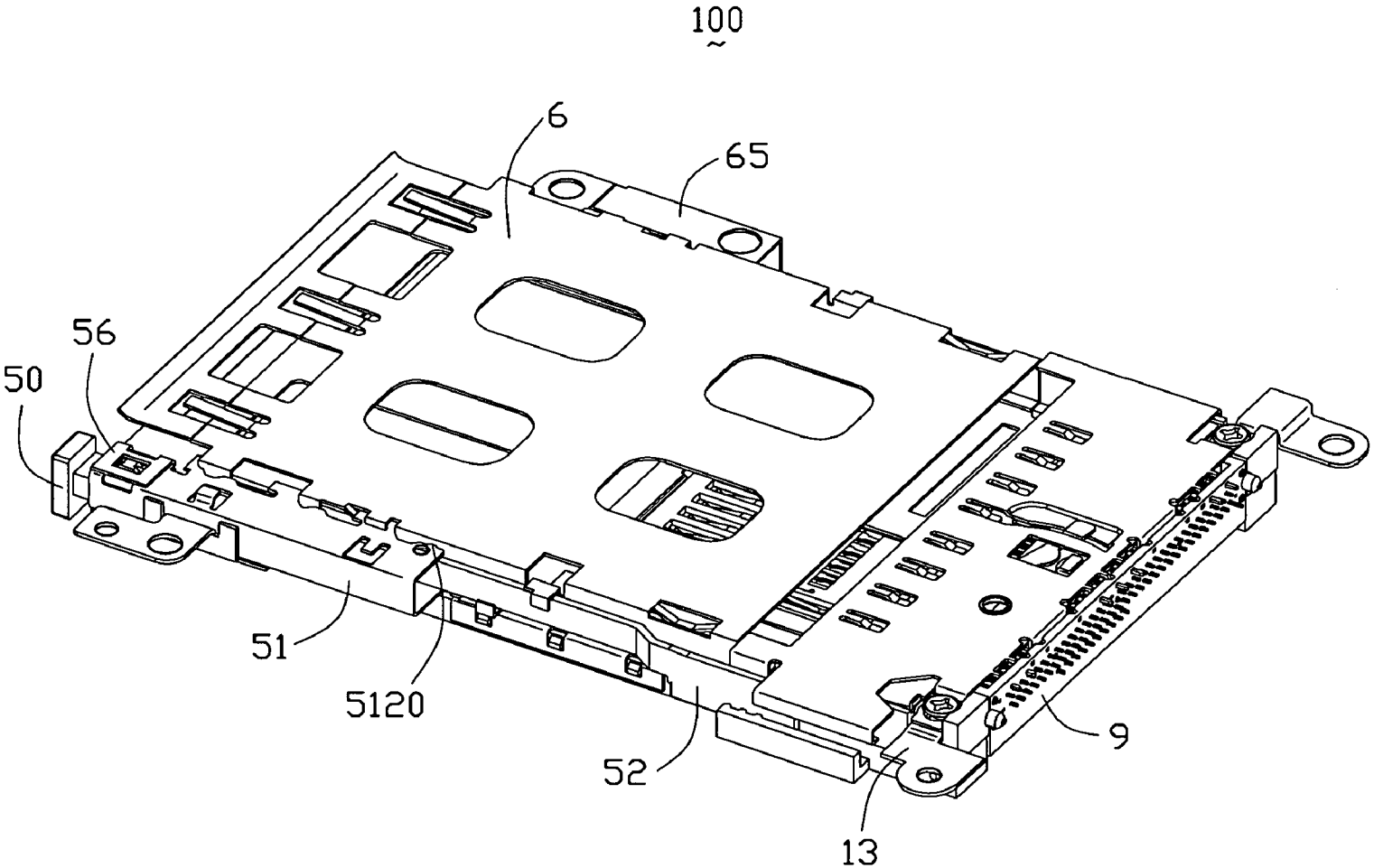
FIG. 1 is a perspective, assembly view of a stacked electrical card connector in accordance with the present invention.

With referring to FIGS. 1-5, a stacked electrical card connector 100 comprises a first insulating housing 1 retaining a plurality of first terminals 3, a second insulating housing 2 retaining a plurality of second terminals 4, an ejecting member 5 mounted on the lateral side of the first insulating housing 1, a first shielding shell 6, a second shielding shell 7, a grounding plate 8 and a spacer 9. The second insulating housing 2 is stacked under the first insulating housing 1.

Figure 3:
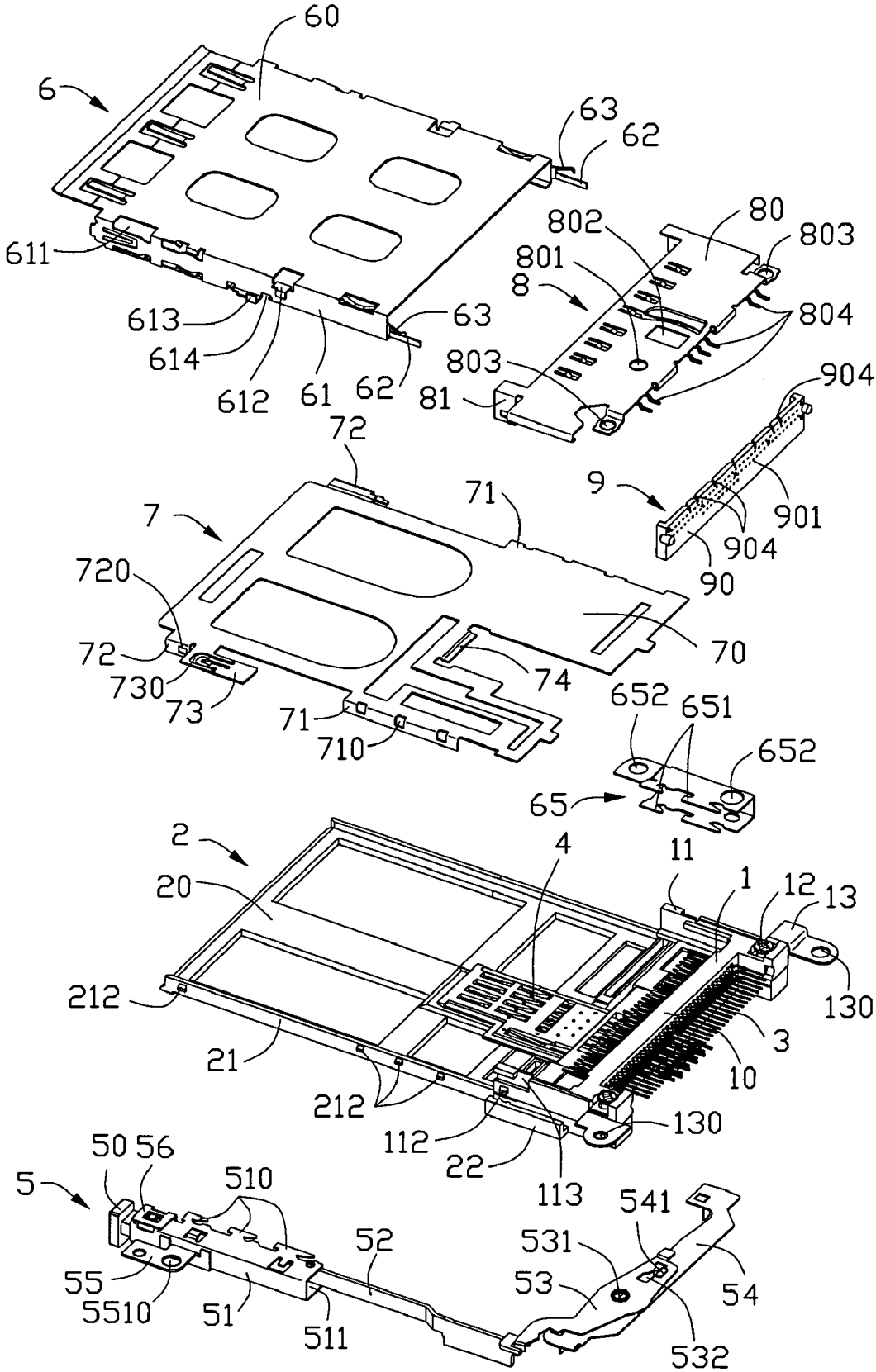
FIG. 3 is an exploded view of the stacked electrical card connector.
Figure 4:
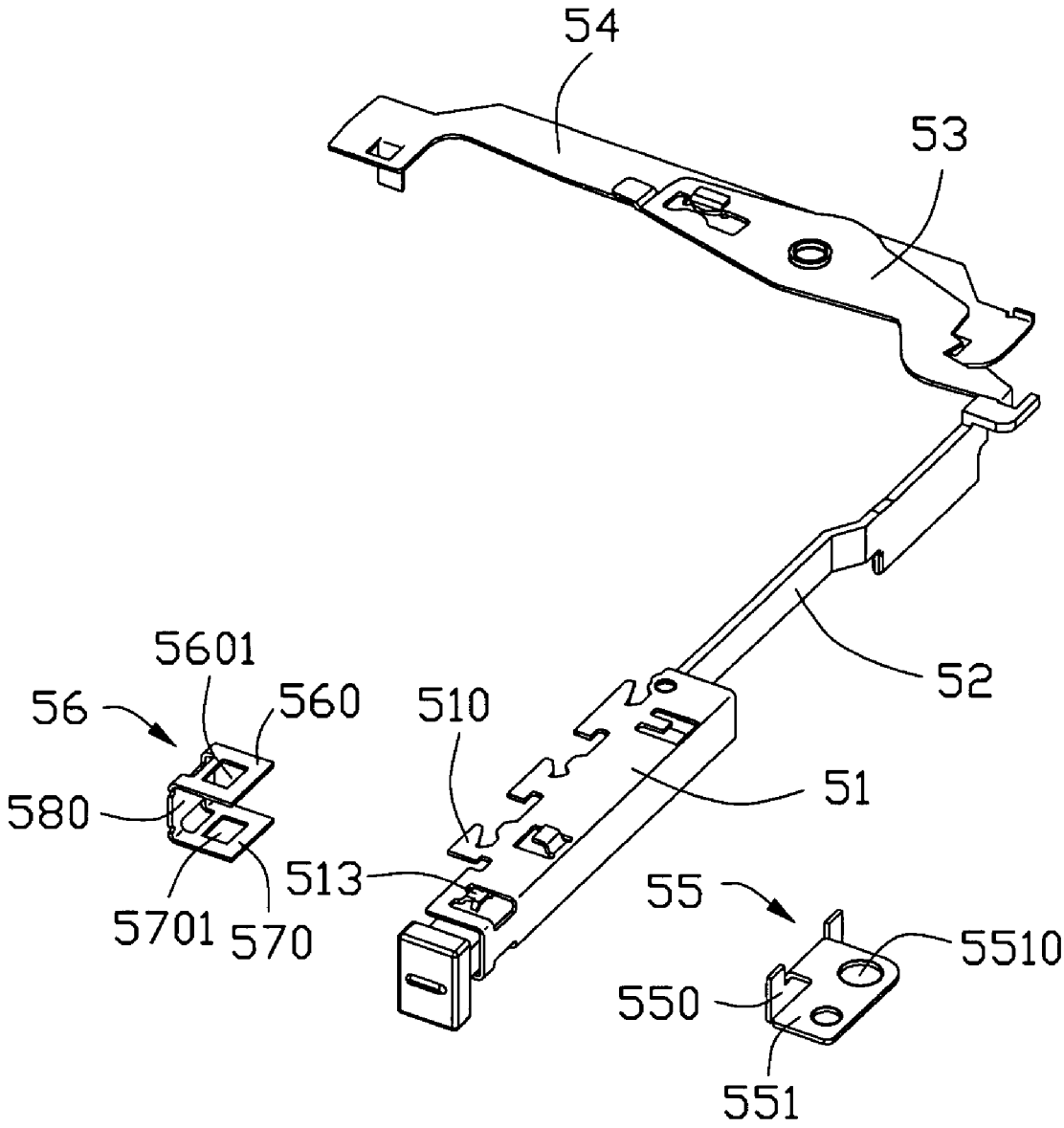
FIG. 4 is an exploded view of an ejecting member of the stacked electrical card connector.
Figure 5:
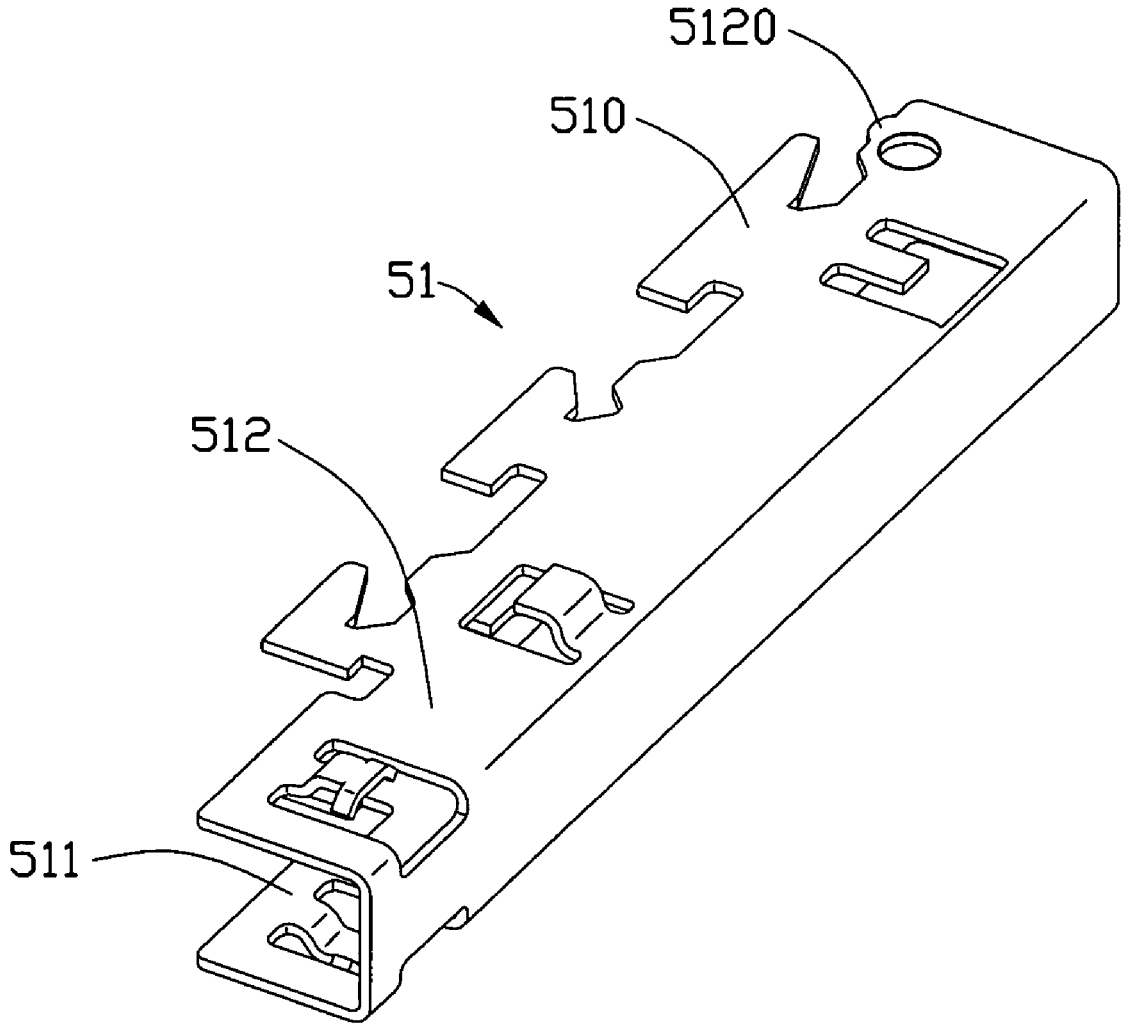
FIG. 5 is a perspective, assembly view of a metal bracket of the ejecting member.

As show in FIG. 3, the first insulating housing 1 comprises a base 10 retaining a plurality of first terminals 3 and a pair of guide arms 11 extending forwardly from the opposite ends of the base 10. At the head of the guide arms 11 a plurality of screw holes (not labeled) are defined, and a plurality of cams 112 are formed on each guide arms 11. The first shielding shell 6 and the second shielding shell 7 define a first card slot 15 for receiving the Card Bus. The first terminals 3 go through the base 10 and protrude into the first slot 15 in the direction of the card inserted for connecting with the electrical card.

The second insulating housing 2 comprises a body portion 20 with a plurality of second terminals 4 and a plurality of side walls 21 extending forwardly and horizontally from the lateral sides of the body portion 20. The side walls 21 comprise a plurality of cams 212 and a latch portion 22 formed by protruding from one head of the side walls 21. On the head of the second insulating housing 2 a screw thread hole (not shown) is defined Furthermore, the second shielding shell 7 according to the present invention will be described in FIG. 3. The second shielding shell 7 comprises a body portion 70, two lateral portions 71 and 72 bending from the opposite sides of the body portion 70. On the lateral portions 71 and 72, two locking holes 710 and 720 are provided, respectively, for locking with the cams 212 of the second insulating housing 2. Closing to the lateral portion 72, a locking piece 73 with a locking hole 730 extends horizontally from the body portion 70. The second shielding shell 7 is mounted on the second insulating housing 2 and defines a second slot 16 for retaining a Smart Card. On the body portion 70, a spring section 74 is formed for providing retention between the second shielding shell 7 and the terminal module 4, so that the head of the terminal module 4 can be located on the spring section 74 of the second shielding shell 7.

Still show in FIG. 3, the first shielding shell 6 comprises an upper portion 60 and a pair of lateral walls 61 extending downwardly from the upper portion 60. At the position of the upper portion 60 and the lateral walls 61 joining, there is a plurality of indentations 611. One locking plate 612 is bent downwardly from one of the lateral walls 61 downwardly, and another locking plate 613 is bent upwardly from another lateral walls 61. Between the locking plate 612 and 613, a placement 614 is defined. The lateral walls 61 comprise a pair of tumbling portion 62 formed on the front end thereof and a pair of elastic arms 63. Each elastic arm 63 is located above corresponding tumbling portion 62.

The first shielding shell 6 is mounted on the second shielding shell 7. The tumbling portion 62 of the first shielding shell 6 is positioned on the mounting recesses 113 formed on the guide arms 11 of the first insulating housing 1. For fixing the stacked electrical connector on a circuit board, there is a mounting section 65 mounted on a side of the first shielding shell 6. The mounting section 65 provides a number of board locks 651 for engaging with the indentations 611 of the first shielding shell 6, and a plurality of screws 652 for fixing the mounting section 65 on the circuit board.

Figure 2:
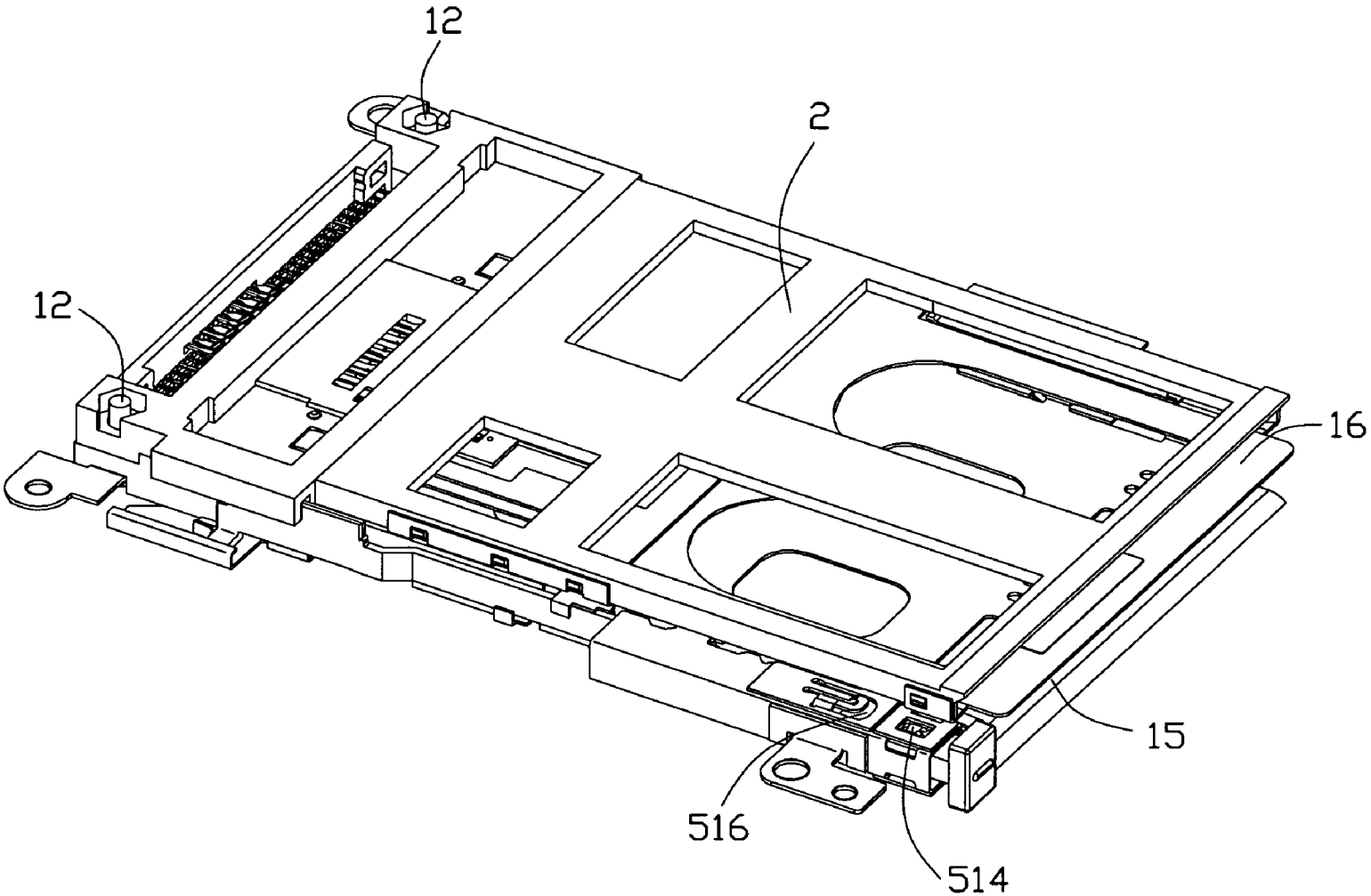
FIG. 2 is another perspective, assembly view of the stacked electrical card connector.
Figure 6:
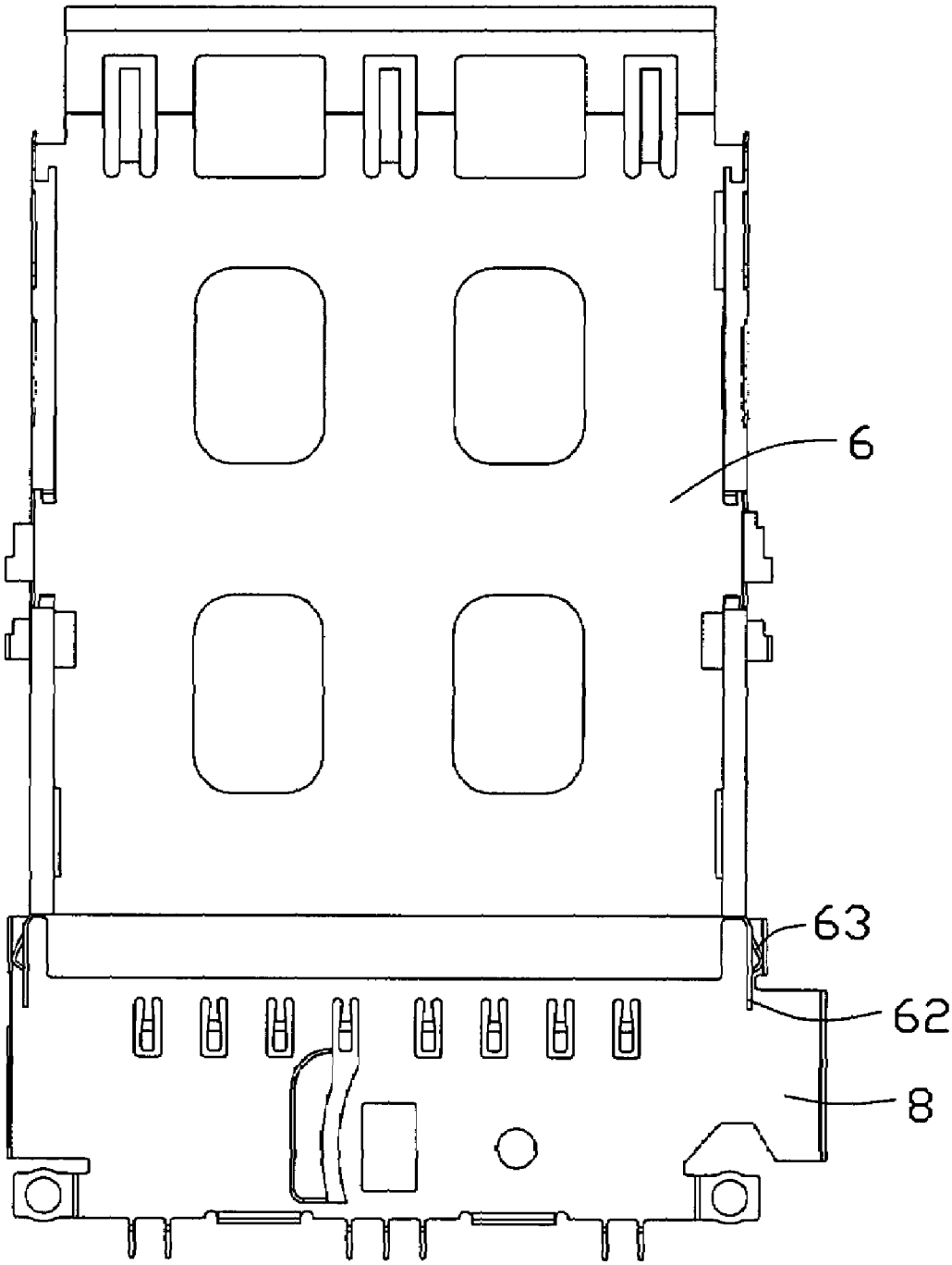
FIG. 6 is a top elevation view of a first shielding shell of the stacked electrical card connector.

As show in FIG. 2 and FIG. 6, the grounding plate 8 comprises a body portion 80 and a pair of limbs 81. The body portion 80 provides a mounting hole 801, a pair of screw thread holes 803 forming on each side of the body portion 80, and a plurality of grounding terminals 804 extending from the head of the body portion 80. The limbs 81 provide a plurality of holes (not labeled) for cooperating with the cams 112 on the guide arms 11 of the first insulating housing 1. When the grounding plate 8 is fitted on the first shielding shell 6, the elastic arms 63 of the first shielding shell 6 lean against the limbs 81 of the grounding plate 8, so as to eliminate the static electricity by the grounding plate 8. The spacer 9 comprises a base section 90 defining a plurality of holes 901 for retaining the first terminals 3 and the second terminals 4.

As show in FIG. 2 to FIG. 5, the ejecting member 5 comprises an ejecting section, a dropping section and a forcing section 56. The ejecting section comprises a metal bracket 51, a pressing pole 50, a projecting pole 52 and a limiting portion (not shown). All the pressing pole 50, the projecting pole 52 and the limiting portion are mounted in the bracket 5. The bracket 51 comprises an upper level section 512 and a lower level section 511. The upper level section 512 parallels the lower level section 511, and the upper level section 512 joins with the lower level section 511 by a perpendicular face (not labeled). On the upper level section 512 and the lower level section 511, a pair of locking plates 513, 514 are formed, respectively. A spring plate (not shown) are also provided on the lower level section 511 for fasten the metal bracket 51 on the locking piece 73 by the spring plate matching with the locking hole 730. On the upper level section 512, a semicircle cam 5120 and a through hole (not labeled) are formed. The through hole is rightly besides the cam 5120 for enhancing toughness and tenacity of the cam 5120 and further to prevent the cam 5120 from being broken. With the through hole, the cam 5120 is more tough and tenacious. A screw board 55 mounted on the bracket 51 comprises a perpendicular portion 550 and a screw portion 551 formed by tending the perpendicular portion 550 horizontally. The screw portion 551 forms a plurality of screw holes 5510. The forcing section 56 seems like a door and is mounted on the ejecting section for enhancing the pressing pole 50. Said pressing pole 50 can increase enough press to push a card out of the first receiving room 15. The forcing section 56 comprises a first horizontal section 560 and a second horizontal section 570. On the horizontal section 560, 570, two locking holes 5601 and 5701 are formed for locking with the locking piece 513 and 514 on the bracket 51, respectively. The projecting pole 52 is fixed by the upper locking piece 612 and the lower locking piece 613 of the first shielding shell 6, at the same time the head of the projecting pole 52 is upheld by the crutch portion 22 of the second insulating housing 2.

The dropping section comprises a moving section 53 and an ejecting portion 54. One end of the moving section 53 engages with the head of the projecting section 52, and the other provides two limiting holes 532, 531. Said ejecting portion 54 is mounted between the first terminals 3 received in the first insulating housing 1 and the grounding plate 8. The ejecting portion 51 comprises a locking piece 541 bending from the ejecting portion 54 through the limiting hole 532 to fasten the ejecting portion 54 on the moving section 53. In the mounting hole 801 a turning axis 531 is retained. The ejecting portion 54 can move around the turning axis 531 with a card inserted or ejected, and the ejecting section of the ejecting member 5 is mounted on the lateral wall 61 of the first shielding shell 6 by the locking piece 510 fastening in the indentations 611 of the first shielding shell 6. Besides, the semicircle cam 5120 lean against the lateral walls 61 of the first shielding shell 6 so that the ejecting member 5 can be mounted on the first shielding compactly. The semicircle cam 5120 can also reduce the impedance of the stacked electrical card connector 100, and eliminate the elastic electricity more effectively.

The stacked electrical card connector 100 is assembled by a plurality of nuts 12 pronging the screw thread holes 803 of the grounding plate 8, the screw holes of the first insulating housing 1 and the screw holes of the second insulating housing 2 in an up-to-down direction. Thereby, the mounting piece 13 is fixed on the first insulating housing 1. The first terminals 3 and the second terminals 4 are retained in the fixing hole 901 of the spacer 9, respectively. The grounding terminals 804 of the grounding plate 8 is received in the receiving passageway 904 correspondingly. The electrical card connector 100 is fixed on the circuit board by the mounting piece 13, the screw plate 55 and the mounting section 65.

As described above, in front of the lateral walls 61 of the first shielding shell 6, a pair of elastic arms 63 are provided and the elastic arms 63 lean against the grounding plate 8 for eliminating the elastic electricity when the Card Bus card is inserted into the first slot 15.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A stacked electrical card connector comprising:

a first insulating housing comprising a base section, said base section receiving a plurality of terminals;

a second insulating housing retaining a plurality of terminals, said first insulating housing located on the second insulating housing;

a first shielding shell comprising a pair of elastic arms extending forwardly from a front end thereof, said first shielding shell mounted on the first insulating housing;

a second shielding shell mounted on the second insulating housing;

a grounding plate assembled on the first insulating housing and located at a front of the first shielding shell along an insertion direction of a card, said grounding plate engaging with the elastic arms of the first shielding shell for eliminating the static electricity when the card is inserted into the first insulating housing.

2. The stacked electrical card connector as claimed in claim 1, wherein the grounding plate provides a plurality of grounding terminals.

3. The stacked electrical card connector as claimed in claim 1, it comprises a spacer with a plurality of holes for retaining the terminals received in the first insulating housing and the second insulating housing.

4. The stacked electrical card connector as claimed in claim 1, wherein a pair of tumbling portion is formed on the front end of the first insulating housing, and said elastic arms is located above corresponding tumbling portion.

5. The stacked electrical card connector as claimed in claim 1, wherein the first shielding shell comprises an upper portion and a pair of lateral walls extending downwardly from the upper portion, and said elastic arms of the first shielding shell is formed at the forepart of the lateral walls.

6. The stacked electrical card connector as claimed in claim 5, wherein the grounding plate comprises a body portion and a pair of limbs extending downwardly from the opposite ends of the body portion, and the elastic arms of the first shielding shell contact with corresponding limbs.

7. The stacked electrical card connector as claimed in claim 1, wherein an ejecting member is fixed on a lateral side of the insulating housing.

8. The stacked electrical card connector as claimed in claim 7, wherein a forcing section like a door is mounted on the ejecting member.

9. An electrical card connector comprising:

an insulating housing receiving a plurality of terminals;

a shielding shell mounted comprising a pair of elastic arms extending forwardly from a front end thereof and on the insulating housing;

an ejecting member mounted on the shielding shell, said ejecting member comprising a metal bracket with a plurality of locking pieces, a through hole, and a cam protruding from an edge thereof to lean against the shielding shell, the through hole being situated beside said cam; wherein a grounding plate comprises a body portion and a pair of limbs extending downwardly from the opposite ends of the body portion, and the elastic arms of the shielding shell contact with corresponding limbs.

10. The electrical card connector as claimed in claim 9, wherein the metal bracket comprises an upper level section and a lower level section, and the locking pieces are defined at a distance on the sides of the level section.

11. The electrical card connector as claimed in claim 10, wherein the cam is located on the head of the upper level.

12. The electrical card connector as claimed in claim 11, wherein the shielding shell comprises a body portion and a pair of lateral walls extending downwardly from the shielding shell, on the shielding shell a plurality of indentations are defined for matching with the locking pieces of the ejecting member, and the cam is formed for leaning against the lateral wall of the shielding shell.

13. The electrical card connector as claimed in claim 12, wherein the forcing section with a pair of opposite horizontal section is located on the metal bracket of the ejecting member for enhancing the ejecting member.

14. The electrical card connector as claimed in claim 13, wherein a plurality of locking plates is formed on the metal bracket for locking with a plurality of locking holes defined on the horizontal section of the forcing section.

15. The electrical card connector as claimed in claim 14, wherein out of the metal bracket a screw board is provided for mounting the assembled electrical card connector on the printing circuit board.

16. An electrical card connector comprising:

an insulating housing receiving a plurality of terminals;

a shielding shell mounted comprising a pair of elastic arms extending forwardly from a front end thereof and on the insulating housing; the shielding shell comprises an upper portion and a pair of lateral walls extending downwardly from the upper portion, and said elastic arms of the shielding shell is formed at the forepart of the lateral walls; wherein a grounding plate comprises a body portion and a pair of limbs extending downwardly from the opposite ends of the body portion, and the elastic arms of the shielding shell contact with corresponding limbs; and an ejecting member mounted on the shielding shell, said ejecting member comprising a metal bracket with a plurality of locking pieces, wherein the metal bracket defines a through hole and a semi-circle edge closely besides said through hole to engage said shielding shell.

17. The electrical card connector as claimed in claim 16, wherein a contour of said through hole is circular, and the semi-circle edge is essentially compliant with said contour.

* * * * *